US010194708B2

(12) United States Patent
Rhodes

(10) Patent No.: US 10,194,708 B2
(45) Date of Patent: Feb. 5, 2019

(54) FULL SLEEVE THERMAL WINTER APPAREL

(71) Applicant: Armi T G A Rhodes, Clarksville, TN (US)

(72) Inventor: Armi T G A Rhodes, Clarksville, TN (US)

( * ) Notice: Subject to any disclaimer, the term of this patent is extended or adjusted under 35 U.S.C. 154(b) by 0 days.

(21) Appl. No.: 16/026,144

(22) Filed: Jul. 3, 2018

(65) Prior Publication Data

US 2018/0310648 A1 Nov. 1, 2018

Related U.S. Application Data

(63) Continuation-in-part of application No. 15/042,107, filed on Feb. 11, 2016, now abandoned.

(51) Int. Cl.

| | |
|---|---|
| ***A41D 19/00*** | (2006.01) |
| ***A41D 27/20*** | (2006.01) |
| ***A41D 27/10*** | (2006.01) |
| *A41D 19/01* | (2006.01) |

(52) U.S. Cl.
CPC ..... *A41D 19/0041* (2013.01); *A41D 27/10* (2013.01); *A41D 27/20* (2013.01); *A41D 19/01* (2013.01); *A41D 2200/20* (2013.01); *A41D 2400/10* (2013.01)

(58) Field of Classification Search
CPC ..... A41D 19/0041; A41D 2200/20; A41D 15/00; A41D 27/10
See application file for complete search history.

(56) References Cited

U.S. PATENT DOCUMENTS 3,214,771 A * 11/1965 Treiber ..... A41D 19/0041 2/270
6,996,847 B2 * 2/2006 Anderson ..... A41D 3/02 2/158

* cited by examiner

*Primary Examiner* — Richale Quinn
(74) *Attorney, Agent, or Firm* — Berggren LLP

(57) ABSTRACT

A full sleeve winter apparel is disclosed where the sleeves of the apparel have an envelope inside the sleeve for concealing gloves, gauntlets or mittens that attached partially from the edge of hand access openings onto the sleeve opening when not used to cover the hands.

10 Claims, 5 Drawing Sheets

FULL SLEEVE THERMAL WINTER APPAREL

PRIORITY

This is a continuation in part application of pending application Ser. No. 15/042,107 filed on Feb. 11, 2016, the contents of which are incorporated herein by reference.

FIELD OF THE INVENTION

The present invention relates to a winter apparel. Particularly, the present invention relates to a thermal winter apparel. More particularly, the present invention relates to a full sleeve thermal winter apparel with concealed gloves and removably attached cap.

BACKGROUND OF THE INVENTION

Sleeves of thermal-protection garments such as coats, jackets, and undergarments generally end at the wrist, leaving the hands and fingers unprotected from cold, requiring gloves or mittens.

Gloves and mittens traditionally have the disadvantages of needing to be carried separately from the coat or jacket, and so frequently are lost. This can be a serious problem for skiers or outdoor users, and a great nuisance for the parents of small children. Also, since gloves and mittens typically cause the wearer to lose dexterity, both children and adults alike are prone to remove the gloves or mittens in order to more easily grasp ski poles, fashion snowballs, etc., thereby adding to the chance that the removed article will be lost. Indeed, fingerless gloves have been developed to address this problem by keeping the hand properly covered while leaving the fingers, or some portion of the fingers, uncovered for better dexterity. But even fingerless gloves can be lost if they are not attached to a coat or garment.

Various disclosures in the past supported the use of such garments designed specifically to be worn in winters. Some examples are as follows:

U.S. Pat. No. 7,823,625 B2 issued to Adroit Development, Inc. discloses an upper body heating and cooling apparatus. More particularly, this invention pertains to a garment worn on the body of a person with the garment connected to a thermal unit. The garment has a heat transfer area and a load bearing area, and the heat transfer capabilities of the garment are not affected by the person carrying a load on a portion of the person's body. The connection between the garment and the thermal unit is with fluid connectors that release upon application of a specified tension force.

U.S. Pat. No. 8,453,270 B2 issued to Columbia Sportswear North America, Inc. discloses a fabric or other material used for body gear and other goods having designed performance characteristics, and in particular to methods and apparatuses that utilize a pattern of heat managing/directing elements coupled to a base fabric to manage heat through reflection or conductivity while maintaining the desired properties of the base fabric.

U.S. Pat. No. 6,332,221 B1 issued to Nicholas Dynes Gracey provides a means by which clothing may be made more effective in its role in assisting temperature regulation by providing increased heat exchange by means of reduced insulation of temperature sensitive sites—reducing insulation of temperature sensitive areas not protected by "fat pads" and/or providing for increased vapor exchange by means of specific ventilation of temperature sensitive areas—allowing flexibility for rapid increases in heat generation owing to facility for improved vapor exchange.

None of the above or any other disclosure known, taken either singly or in combination, are seen to disclose a full sleeve thermal winter apparel for a person.

Further, none of this known art suggests the present inventive combination of component elements arranged and configured for the efficient solution of this problem as disclosed and claimed herein. Prior devices do not provide the benefits of the present invention which achieves its intended purposes, objectives and advantages over the prior art devices through a new, useful and nonobvious combination of component elements, through no increase in the number of functioning parts, at a minimum cost and through the utilization of only readily available materials and conventional components.

As such, it may be appreciated that there continues to be a need for a new and improved full sleeve thermal winter apparel for a person with concealed gloves and removably attached cap for reducing the chances of losing the gloves and in this respect, the present invention substantially fulfills this need.

SUMMARY OF THE INVENTION

The present invention solves the problems of the prior art by providing a novel full sleeve thermal winter apparel for a person.

It is an object of the present invention is to provide a full sleeve thermal winter apparel with concealable gloves or mittens or similar means to cover hands. The apparel may include a removable cap and one or more pockets.

It is an object of this invention to provide a full sleeve thermal winter apparel, comprising a torso covering portion and two sleeves having an outer and an inner surface, each sleeve having a top end attached to the torso covering portion, and a bottom end having a sleeve opening;

wherein a mitten, gauntlet, or a glove having a hand access opening is attached to the bottom end of each sleeve from an edge of the hand access opening such that the hand access opening remains open, and wherein an envelope having an envelope opening is attached onto the inner surface of the bottom end of each sleeve such that the envelope opening faces same direction as the sleeve opening and is configured to receive the mitten, gauntlet or glove when not used to cover a hand.

It is another object of this invention to provide a full sleeve thermal winter apparel wherein a mitten, a gauntlet or a glove having a hand access opening is attached to the bottom end of each sleeve at the sleeve opening from an edge of the hand access opening by a length of 1/10 to 1/2 of the edge of the hand access opening.

Yet another object of this invention is to provide a full sleeve thermal apparel, wherein a mitten or glove is attached to the bottom end of each sleeve permanently by sewing 1/10-1/2 length of the edge of a hand access opening to the edge of sleeve opening.

Still another object of the invention is to provide a full sleeve thermal apparel wherein a mitten, a gauntlet, or a glove having a hand access opening is attached to the bottom end of each sleeve from an edge of the hand access opening such that the hand access opening remains open, and wherein an envelope being a pouch and having an envelope opening is attached onto the inner surface of the bottom end of each sleeve such that the envelope opening faces same direction as the sleeve opening and the envelope is configured to receive the mitten, gauntlet or glove when not used to cover a hand.

A further object of the invention is to provide a full sleeve thermal apparel wherein a mitten or a glove having a hand access opening is attached to the bottom end of each sleeve from an edge of the hand access opening such that the hand access opening remains open, and wherein an envelope being a single layer fabric is attached onto the inner surface of the bottom end of each sleeve such that an envelope opening faces same direction as the sleeve opening and is configured to receive the mitten, gauntlet or glove when not used to cover a hand.

A further object of the present invention is to provide a thermal winter apparel with an envelope inside the sleeves to conceal gloves or mittens and further having a detachable cap and pockets for placing the detachable accessory of the thermal winter apparel.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be had to the accompanying drawings and descriptive matter in which there are illustrated preferred embodiments of the invention.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
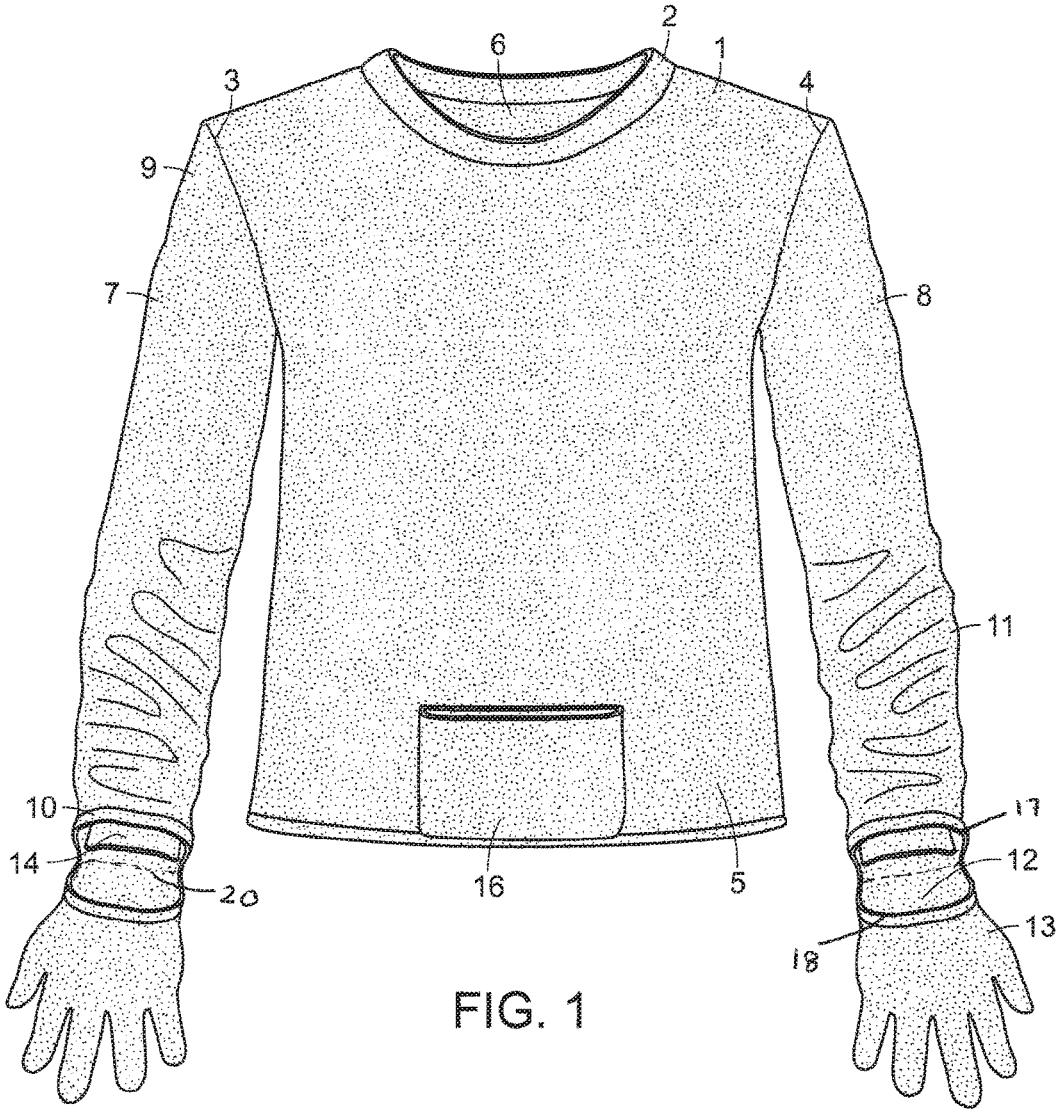
FIG. 1 shows the front view of the full sleeve thermal winter apparel with gloves attached to the sleeve openings and an envelope attached inside the sleeves.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized, and that structural and logical changes may be made without departing from the spirit and scope of the present invention. The following detailed description is, therefore, not to be taken in a limiting sense, and the scope of the present invention is defined by the appended claims and their equivalents.

Referring now to the drawings, wherein like reference characters designate identical, or corresponding parts throughout the figures, and in particular FIGS. 1, 2, 3, 4 and 5 show various embodiments of full sleeve thermal winter apparel in accordance with the present invention.

FIG. 1 shows the front view of the full sleeve thermal winter apparel including, an enveloping torso portion 1 having an opening for the head 2, a right seam 3, a left seam 4, an upper surface 5, an inner surface 6, a right sleeve 7 and a left sleeve 8, both sleeves having a top end 9, a bottom end 10, an outer surface 11, an inner surface 12, and sleeve openings, gloves 13 having a hand access opening 18 with an edge 20 and being attached at the bottom end of the sleeves, envelopes 14 attached on inner surface of the sleeve and having envelope openings 19 facing same direction as the sleeve openings, and a pocket 16.

Figure 2:
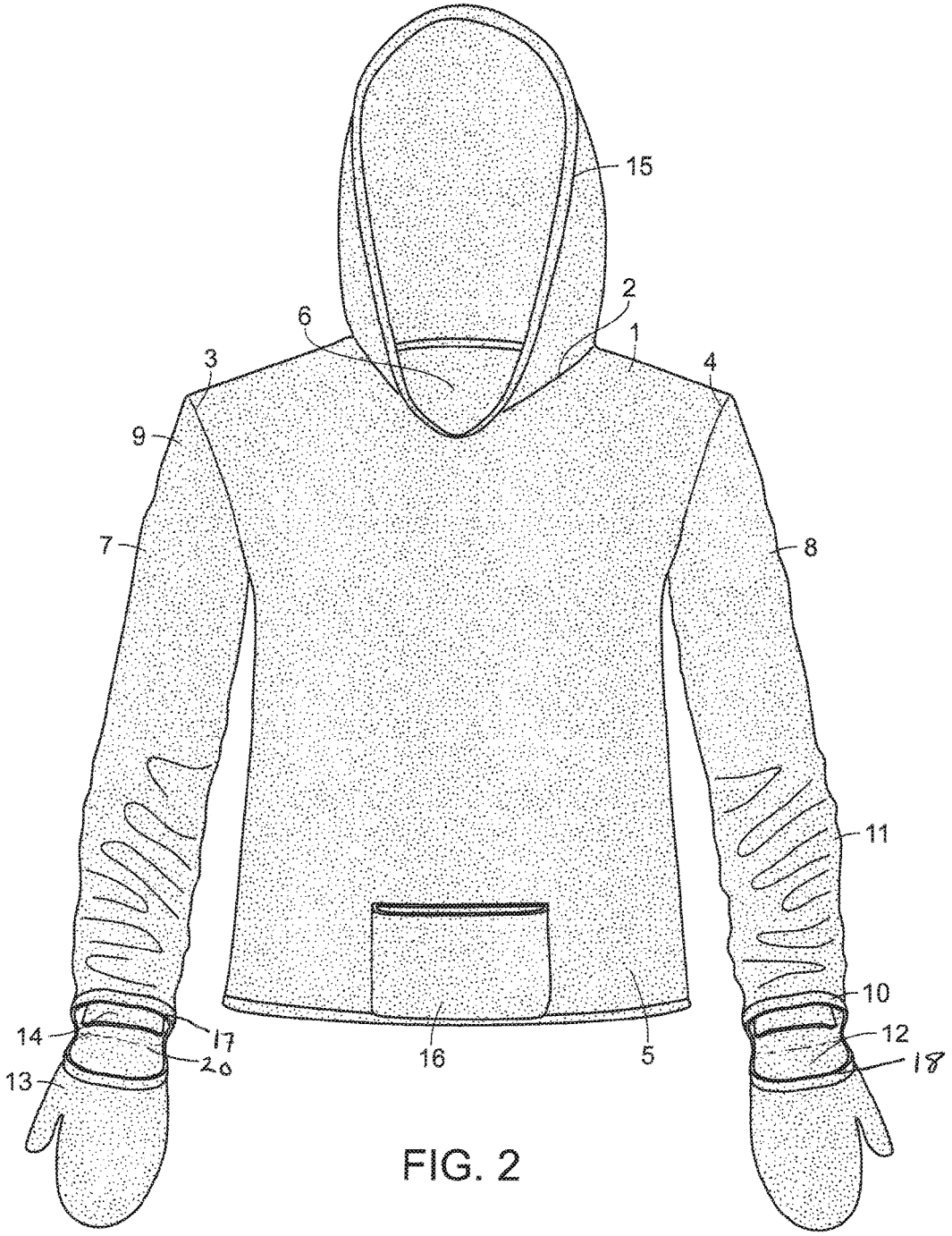
FIG. 2 shows the front view of the full sleeve thermal winter apparel with mittens attached onto the sleeve openings and an envelope attached inside the sleeve. A cap and a pocket are also illustrated.

FIG. 2 shows the front view of the full sleeve thermal winter apparel including, an enveloping torso portion 1 having an opening for the head 2, a right seam 3, a left seam 4, an upper surface 5, an inner surface 6, a right sleeve 7 and a left sleeve 8, both sleeves having a top end 9, a bottom end 10, an outer surface 11, an inner surface 12, and sleeve openings, mittens 13 having a hand access opening 18 with an edge 20 and being attached at the bottom end of the sleeves, envelopes 14 attached on the inner surface of the sleeve and having envelope openings facing same direction as the sleeve openings, and a pocket 16.

Figure 3:
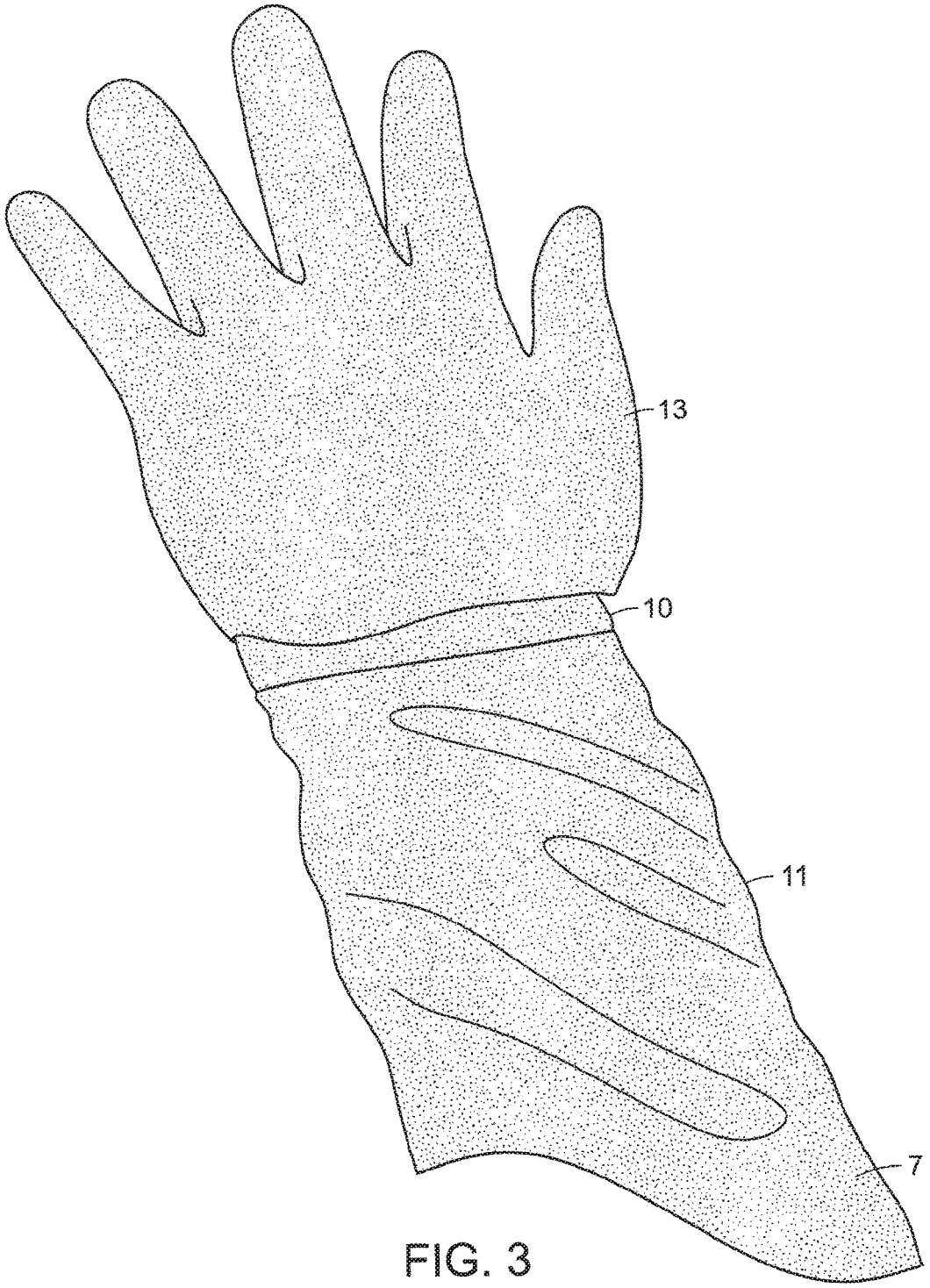
FIG. 3 shows a view of a sleeve with glove in an embodiment of the present invention.

FIG. 3 shows a view of the right sleeve 7 including, the glove 13, attached to the bottom end 10 of the right sleeve 7.

Figure 4:
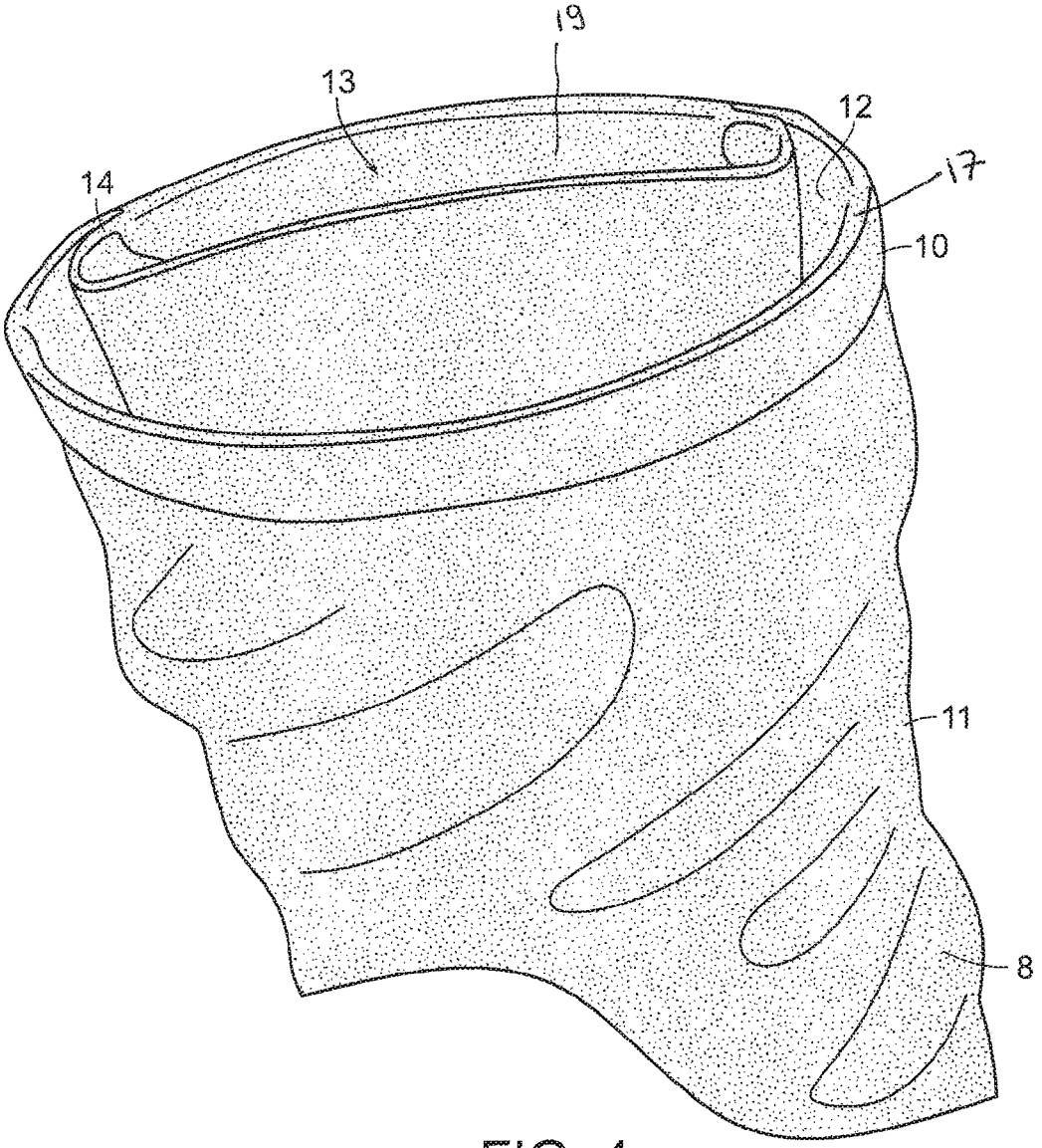
FIG. 4 shows a view of a sleeve with an envelope attached on the inner surface of the sleeve at the sleeve opening and a glove or mitten inside the envelope.

FIG. 4 shows a view of a sleeve 08 with envelope 14 attached on the inner surface of onto the sleeve opening 17. The envelope has an opening 19 facing same direction as the opening of the sleeve 17. A mitten or glove 13 attached to the bottom end of the sleeve 10 is inserted into the envelope. Here the envelope is a pouch.

Figure 5:
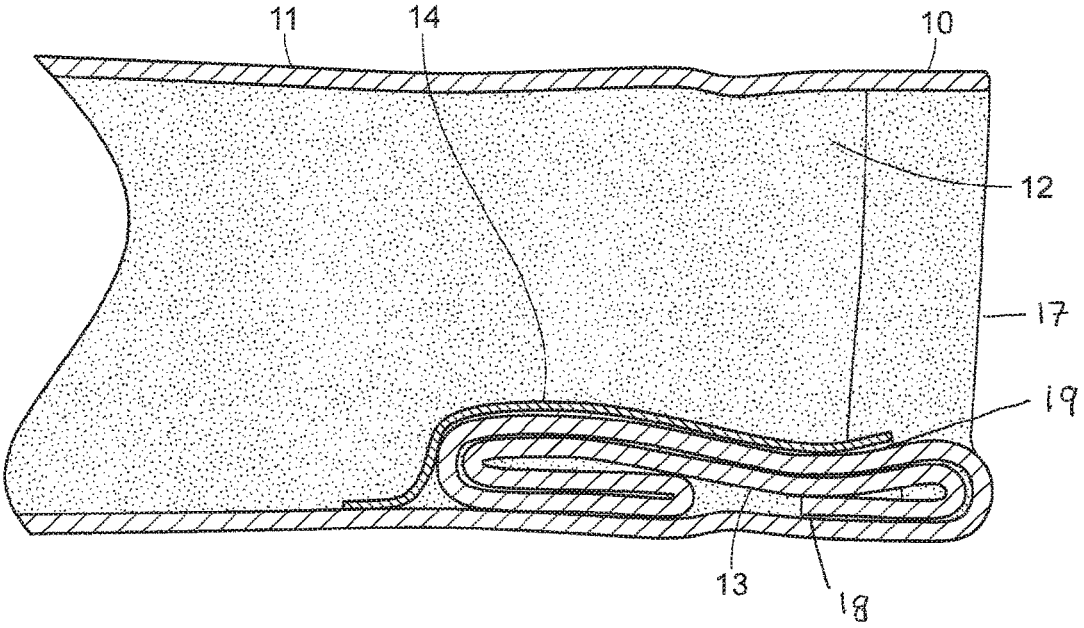
FIG. 5 shows a cross sectional view of a sleeve where inside the sleeve there is an envelope which is attached onto the inner surface of the sleeve and having an opening facing the sleeve opening and into which a glove or mitten is concealed.

FIG. 5. shows a cross sectional view of a sleeve. The outer surface 11 of the sleeve as well as the inner surface 12 of the sleeve are shown. The bottom end 10 of the sleeve is shown. The envelope 14 is attached onto the inner surface 12 of the sleeve such that the envelope has an opening 19 facing the same direction as the sleeve opening 17. A glove or mitten 13 is partially attached to the bottom end 10 of the sleeve such that a hand access opening 18 remains open. The glove or mitten 13 is inserted into the envelope 14 via the envelope opening 19. Here the envelope is a single layer fabric attached onto the inner surface of the sleeve such that the envelope opening faces same directions as the sleeve opening.

In general, present invention provides the full sleeve thermal winter apparel for a person, including the enveloping torso portion 1, the right sleeve 7, the left sleeve 8, the means for covering the hands 13, envelopes 14 for concealing the means for covering the hands 13, means for covering the head 15 and pocket 16 for placing the means for covering the head 15 when detached.

In an embodiment the present invention provides the full sleeve thermal winter apparel for a person including, the enveloping torso portion 1 configured to cover a portion of a torso of the person further including the opening for the head 2 of the person to extend out of when the full sleeve thermal winter apparel is worn by the person, the right seam 3, the left seam 4, the upper surface 05 and the inner surface 6. Further, the right sleeve 7 ad left sleeve 8 comprising the top end 9, the bottom end 10, the outer surface 11 and the lower surface 12, the means for covering hands of the person 13, at least one envelope 14 for concealing the means for covering hands 13 of the person, the means for covering the head 15 of the person, and at least one pocket 16 for placing the means for covering the head 15 of the person located at the upper surface 05 of the enveloping torso portion 01.

The envelopes 14 for concealing the mittens, gauntlets or gloves 13, are attached inside the bottom ends of the sleeves in such a manner that the envelope openings 19 are facing same direction as the sleeve openings 17. The gloves or mittens are partially attached onto the bottom ends of the sleeves, preferably onto the sleeve openings such that the glove or mitten can be inserted into the envelope when not used. The glove, gauntlet or mitten is attached partially onto the bottom end of the sleeves or onto the sleeve opening in such a way that the hand access opening 18 of the glove, gauntlet or mitten remains open. Preferably about 1/10 to 1/2 of the length of the edge 20 of the hand access opening 18 of the glove or mitten is attached to the sleeve opening 17 or the bottom end of the sleeve. The glove, gauntlet or mitten is preferably attached permanently by sewing but other more temporary means may as well be used, such as attachment by Velcro® or press buttons. The envelope may be constructed in a form of a poach (as shown in FIG. 4) or simply as a single layer fabric attached onto the inner side of the sleeve (as shown in FIG. 5).

In various embodiments of the present invention the enveloping torso portion 1 is made of material selected from the group of lightweight, waterproof, stretchable, wind resistant materials or combination thereof and including the opening for the head 2 of the person to extend out of when the full sleeve thermal winter apparel is worn by the person, the right seam 3, the left seam 4, the upper surface 5 and the inner surface 6.

In various embodiments of the present invention the right sleeve 7 ad left sleeve 8 are made of material selected from the group of lightweight, waterproof, stretchable, wind resistant materials or combination thereof comprising the top end 9, the bottom end 10, the outer surface 11 and the inner surface 12, the means for covering hands of the person 13 and envelope 14 for concealing the means for covering hands 13 of the person.

In various embodiments of the present invention the means for covering the hands 13 is selected from the group of gloves, gauntlets and mittens and made of material selected from the group of lightweight, waterproof, stretchable, wind resistant materials or combination thereof. The means for covering the hands 13 are located at the bottom end 10 of the right sleeve 7 and left sleeve 8.

In various embodiments of the present invention the means for covering the head 15 is made of material selected from the group of lightweight, waterproof, stretchable, wind resistant materials or combination thereof and located at the opening for the head 2 of the person to extend out of the enveloping torso portion 1.

In one preferred embodiment of the present invention provides the full sleeve thermal winter apparel for a person, including the enveloping torso portion 1 made of lightweight, waterproof, stretchable and wind resistant material configured to cover a portion of a torso of the person further including the opening for the head 2 of the person to extend out of when the full sleeve thermal winter apparel is worn by the person. In this embodiment the right sleeve 7 and the left sleeve 8 are made of lightweight, waterproof, stretchable and wind resistant material connected at the right seam 3 and left seam 4 respectively. In this particular embodiment the means for covering the hands 13 is gloves made of lightweight, waterproof, stretchable and wind resistant material located at the bottom end 10 of the right sleeve 07 and the left sleeve 8 further concealable in the envelopes 14 located at the lower surface 12 of the right sleeve 07 and the left sleeve 8. Also, in this particular embodiment the cap 15 is attached to the enveloping torso portion 1 at the opening for the head 2 which could be removed and placed in the pocket 16 located at the upper surface 5 of the enveloping torso portion 1.

It is to be understood that the above description is intended to be illustrative, and not restrictive. For example, the above-discussed embodiments may be used in combination with each other. Many other embodiments will be apparent to those of skill in the art upon reviewing the above description.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

What is claimed is:

1. A full sleeve thermal winter apparel, comprising a torso covering portion and two sleeves having an outer and an inner surface, each sleeve having a top end attached to the torso covering portion, and a bottom end having a sleeve opening;

wherein a mitten, a gauntlet or a glove having a hand access opening is attached to the sleeve opening of each sleeve from an edge of the hand access opening by a length of 1/10 to 1/2 of the edge of the hand access opening, such that the hand access opening remains open, and wherein an envelope having an envelope opening is attached onto the inner surface of the bottom end of each sleeve such that the envelope opening is inside the sleeve, and faces same direction as the sleeve opening and is configured to receive the mitten, gauntlet or glove when not used to cover a hands.

2. The full sleeve thermal apparel according to claim 1, wherein the mitten, gauntlet or glove is attached to the bottom end of each sleeve by sewing.

3. The full sleeve thermal apparel according to claim 1, wherein the envelope is a pouch attached onto the inner surface of the bottom end at the sleeve opening.

4. The full sleeve thermal apparel according to claim 1, wherein the envelope consists of a single layer fabric attached onto the inner surface of the sleeve.

5. The full sleeve thermal winter apparel according to claim 1, wherein the apparel further comprises a cap.

6. The full sleeve thermal winter apparel according to claim 1, wherein the apparel further comprises one or more pockets.

7. The full sleeve thermal winter apparel according to claim 1, wherein the torso covering portion is made of material selected from the group consisting of waterproof, stretchable, wind resistant materials, and combinations thereof.

8. The full sleeve thermal winter apparel according to claim 1, wherein the sleeves are made of material selected from the group consisting of waterproof, stretchable, wind resistant materials, and combinations thereof.

9. The full sleeve thermal winter apparel according to claim 1, wherein the mitten, gauntlet or glove is made of material selected from the group consisting of waterproof, stretchable, wind resistant materials, and combinations thereof.

10. The full sleeve thermal winter apparel according to claim 5, wherein the cap is made of material selected from the group consisting of waterproof, stretchable, wind resistant material, and combinations thereof.

* * * * *